United States Patent [19]

Baba et al.

[11] 4,192,673

[45] Mar. 11, 1980

[54] METHOD OF MANUFACTURING GRANULATED FERRONICKEL

[75] Inventors: Kohzo Baba, Hyuga; Itsuyoshi Nagatomo, Miyazaki, both of Japan

[73] Assignee: Hyuga Smelting Co., Ltd., Hyuga, Japan

[21] Appl. No.: 970,956

[22] Filed: Dec. 19, 1978

[51] Int. Cl.[2] ..... B22D 23/08

[52] U.S. Cl. ..... 75/0.5 C; 75/0.5 BA; 264/111

[58] Field of Search ..... 75/0.5 C, 0.5 BA; 264/11

[56] References Cited

U.S. PATENT DOCUMENTS

| | | | |
|---|---|---|---|
| 1,669,649 | 5/1928 | Beath et al. | 75/0.5 BA |
| 2,322,327 | 6/1943 | Timmins | 75/0.5 C |
| 3,540,877 | 11/1970 | Rigg et al. | 75/0.5 BA |
| 3,684,479 | 8/1972 | Fabo | 75/0.5 BA |

*Primary Examiner*—W. Stallard

*Attorney, Agent, or Firm*—Watson, Cole, Grindle & Watson

[57] ABSTRACT

A method of manufacturing granulated ferronickel by deoxidizing fused ferronickel containing no less than 0.1%, preferably 0.2 to 3.0%, of carbon with addition of a deoxidizing agent such as Al, ferrosilicon ferromanganese and the like, while blowing inert gas into the melt and/or with use of a vacuum degassing apparatus if necessary, and then water granulating the deoxidized metal. The granulated ferronickel thus obtained is small in size and convenient to handle.

8 Claims, 4 Drawing Figures

METHOD OF MANUFACTURING GRANULATED FERRONICKEL

BACKGROUND OF THE INVENTION

1. Field of the Invention

This invention relates to a method of manufacturing granulated metal from fused ferronickel, partiailarly, to method of manufacturing granulated metal suitable for producing alloy steel.

2. Description of the Prior Art

For producing granulated metal from fused metal various methods have hitherto been proposed or put in practice; for example, one in which high pressure water is jetted against a fused metal stream to crash the fused metal (Japanese Patent publication No. 8675/1978), one which a fused metal stream is allowed to fall into a water pond while blowing air jets against the fused metal stream immediately below the water surface to obtain a shot thereby (Japanese Patent lay-open Print No. 66468/1975), and one in which granulation is effected by producing horizontal water streams directed in different directions within a water pond and pouring fused metal into the water pond (Japanese Patent publication No 34309/1973).

In the manufacture of granular metal from fused ferronickel by one of the well-known water granulation methods mentioned above, it is possible to obtain granules which can be sufficiently put in practice by appropriately selecting the water granulating means in case of fused ferronickel with low carbon content. However, in case that the carbon content in the fused ferronickel is above a certain value, granular metal can no longer be obtained, but there result indefinite shapes, for instance greatly wrinkled thin flat forms just like what is obtained by crumpling paper into a ball and then lightly expanding it, those like a Jew's ear (Auricularia auriculajudae) or those having many projections, even by employing any sort of water granulating means.

Such shapes, as shown in FIG. 3 for instance, are naturally low in bulk specific gravity and are likely to get entangled, thus posing problems in discharging from a hopper by definite quantities, transportation by conveyor means, drying after water granulation and so forth. Further, in case of using such metal, for instance, as cold material in the manufacture of stainless steel, in which case it is thrown into raw stainless steel melt, if the melt contains slags, it floats on the slags because its bulk specific gravity is low, so that its quick melting cannot be expected.

A recent trend in a stainless steel manufacturing process is to replace the conventional electric arc furnace process with an AOD (argon oxygen decarburizaton) process, that is, an Ar-$O_2$ gas bottom blow process in accordance with the advancement of the electric furnace and peripheral techniques.

The AOD process can overcome such drawbacks inherent in the electric arc furnace process as long decarburization treatment at a high temperature (of about 1,800° C.), accompanying conversion of chromium into slay, reducing step for preventing loss of chromium and further limitation imposed upon the material (i.e., incapability of treating materials of high carbon content), because it permits to keep the CO partial pressure low within the furnace, to treat materials even of high carbon content, to reduce the period required for the manufacture of steel practically to one half and reduce the loss of chromium.

This AOD process, however, has a drawback that the furnace temperature is increased (to 1,800° C. or above) at the time of the decarburization treatment, so that corrosion of lining by fusion is liable to result due to this high temperature. Therefore, it is necessary to add a suitable cold material at the time of the decarburization. As the cold material it is possible to use granular low carbon ferronickel and ferrochromium and iron pieces which have been used as material or composition adjustment agent in the prior-art electric arc furnace process, but they are expensive. Stainless steel scrap might be thought as an alternative, but it is bulky and thus requires some treatment.

Accordingly, there has been a strong demand for high carbon ferronickel, which can serve both as cold material and as composition adjustment agent as well as being inexpensive, small in grain size and convenient to handle, that is, solid granular shots of sufficient flow property.

SUMMARY OF THE INVENTION

An object of the invention is to provide a method, which permits efficient production of granules of high carbon ferronickel which can meet the above demand.

In order to achieve this object, the inventors have conducted various researches and investigations regarding the method of water granulating high carbon feronickel, but satisfactory granular metal have not been obtained. After subsequent extensive experiments conducted by varying the carbon content in ferronickel, it has been found that granular metal cannot be obtained but the afore-mentioned thin shapeless metal result if the carbon content in ferronickel above 0.1% by weight.

The reason why this results is not clear, but it is presumed that the fused metal in the furnace or ladle always contains some dissolved oxygen introduced as a result of its contact with slags or the like. When the melt is suddenly cooled at the time of the water granulation, oxygen contained in it in excess of the limit of dissolution is thought to react violently with carbon in the melt, as represented by $$\underline{C}+\underline{O}\rightarrow CO\uparrow$$

thus produce at once a great deal of high temperature CO gas, which tends to scatter outwardly of the melt so that it may cause the melt which envelops the gas to be expanded just like a balloon and resultantly to be ruptured. In the case that the carbon content is low excessively, that is, within a range of 0.00N up to 0.02% by weight, although oxygen that can react with carbon at the time of the water granulation is present, such gas as produced in the case of the high carbon content is not produced so that no problem arises in the water granulation.

On the basis of the above presumption it has been thought that the above phenomenon in high carbon ferronickel could be precluded if oxygen produced in excess of the limit of dissolution in the melt during preparatory steps before water granulation would be removed, and a greater effect than expection is obtained by deoxidizing the melt with a suitable deoxidizing agent before water granulating it. The invention is predicated in this effect.

More particularly, the invention is based upon the fact that granular shots of high bulk specific gravity and small angle of repose can be obtained by deoxidizing fused ferronickel within the furnace or having been transferred to the ladle and containing no less than 0.1%, preferably 0.2 to 3.0%, by weight of carbon with direct addition of a deoxidizing agent such as Al, ferrosilicon, ferromanganese, and the like, then water granulating the jused ferronickel by a known method and subsequently drying the product.

Suitable examples of the deoxidizing agent are Al, ferrosilicon and ferromanganese, and particularly Al. However, they are by no means limitative, and it is possible to use any other agent having an adequate deoxidizing effect and free from posing any problem on the chemical composition of the granular ferronickel. The amount of the deoxidizing agent is usually about 1/1,000 by weight of the fused ferronickel, but may be suitably varied depending upon the property of the fused metal which is dealt with.

When effecting deoxidization by using a deoxidizing agent, the deoxidizing effect is promoted by blowing an inert gas such as Ar into the melt and/or using a vacuum degassing apparatus in combination.

DETAILED DESCRIPTION OF THE INVENTION

Figure 1:
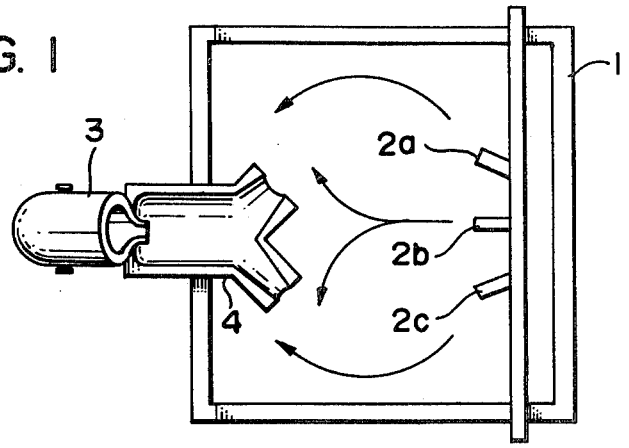
FIG. 1 is a plan view showing an example of an apparatus for water granulating the melt for carrying out the method according to the invention.

The water granulation of fused ferronickel after deoxidization can be carried out with any suitable well-known apparatus, and an example of the water granulating apparatus will now be described with reference to FIGS. 1 and 2.

A water pond 1 for granulation is provided in its inside or on its wall with a plurality of water jet nozzles *2a*, *2b* and *2c* having different jetting directions and located at different levels.

A ladle 3 is provided above the water pond 1, and the melt is supplied from the ladle 3 through a launder 4 to the water pond 1. At the bottom of the water pond 1 a container 5 for collecting granulated metal or a steel conveyor (not shown) inclined at an angle of 10° to 45° for continuously transferring the granulated metal to the outside (see Japanese Patent Publication No. 34309/1973) is provided.

By jetting water from a plurality of water jet nozzles *2a*, *2b* and *2c* water streams directed in different directions and different in level are formed within the water pond 1. Meanwhile, a melt poured into the ladle 3 is deoxidized for several minutes by adding a suitable amount of an deoxidizing agent to it, and then by tilting the ladle 3 the melt is supplied through the launder 4 into the water pond 1. Within the water pond 1, the melt is granulated and collected in the container 5 or, in case of transferring by a conveyor, in an outside container (not shown). In this case, by appropriately controlling the rate of supply of the melt and the rate of supply of water it is possible to continuously granulate a great quantity of melt in a short period of time with a shallow water pond and simple peripheral means and obtain shots of a proper grain size, i.e. not including fine grain size.

The granulated metal thus obtained is transferred to a suitable drying means or, in the case of transferring it with a conveyor, is dried by heating or air blow during its transfer.

As has been described in the foregoing, according to the invention it is possible to efficiently produce granulated metal of high bulk specific gravity, small angle of repose and of narrow grain size distribution and capable of solving all the problems in the granulated metal obtained by the prior-art process (i.e., problems in transfer, storage and discharge in predetermined quantities from hopper). Granulating ferronickel with a carbon content outside the range according to the invention, that is, below 0.1% by weight, is undesirable because the product, although it is granular, also contains granules containing water inside.

Figure 4:
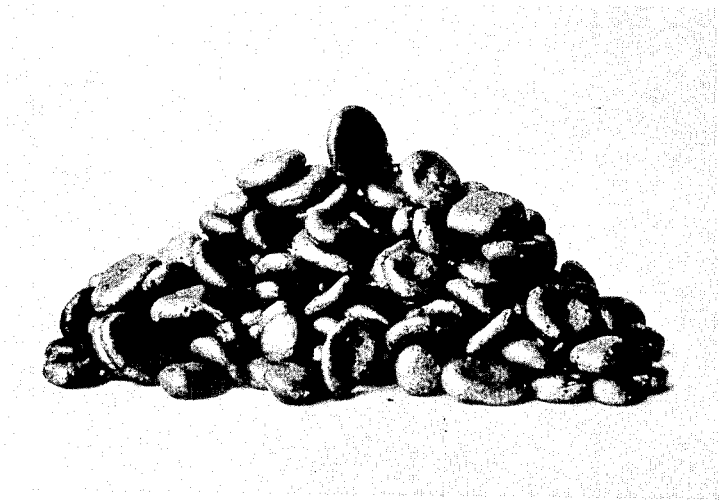
FIG. 4 is a photograph showing granular metal obtained by the method according to the invention.

The shots obtained according to the invention, as typically shown in FIG. 4, consist, in majority, of round, slightly flat balls, which can be said to be optimum as the cold material for the afore-mentioned AOD process.

Examples of the invention will now be described in comparison with a prior-art example.

EXAMPLE 1

Figure 2:
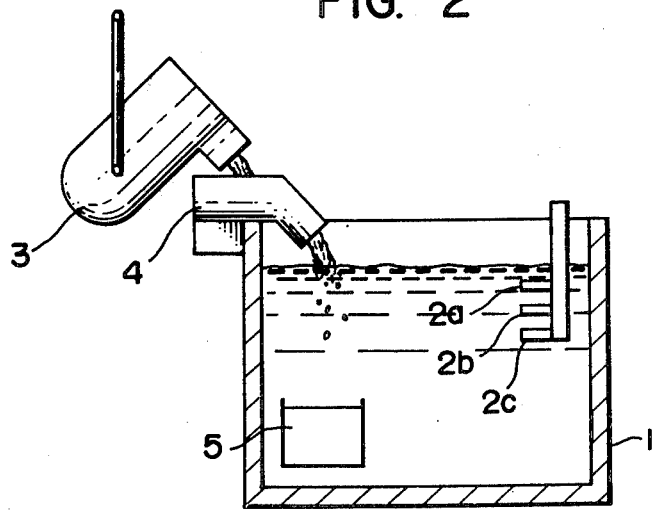
FIG. 2 is an elevational sectional view of the water granulator shown in FIG. 1.
Figure 3:
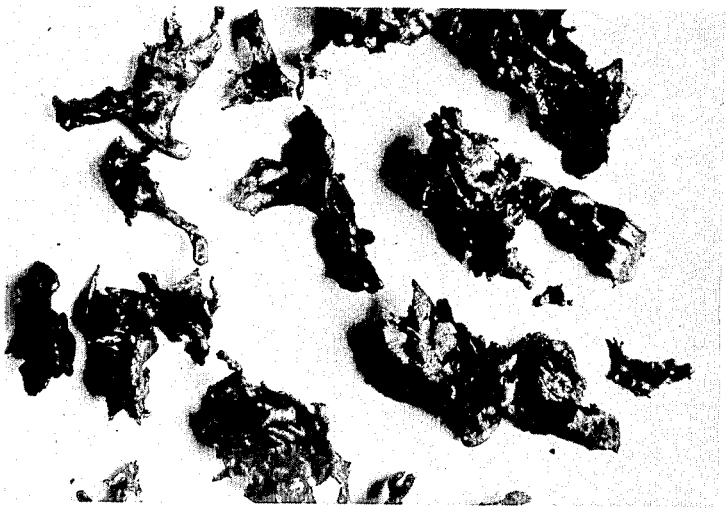
FIG. 3 is a photograph showing granular metal obtained by the prior-art method.

15 t of fused ferronickel (at about 1,450° C.) transferred to the ladle and having a composition as shown in Table 1 was deoxidized by adding 15 kg of aluminum masses and holding the resultant mixture for several minutes, followed by granulation for about 15 minutes with the water granulating apparatus as shown in FIGS. 1 and 2. The water depth in the water pond was set to 2.5 m, and water was supplied at a rate of 2.5 $m^3$/min. Then, fused ferronickel (at about 1,450° C.), the composition of which being substantially the same as shown in Table 1, was subjected to granulation for 15 minutes with the same water granulating apparatus without effecting any deoxidization treatment. In each case, the shot obtained by the granulation is taken out from the container, and after drying it its characteristics were examined. The results are shown in Table 2. Table 3 shows the grain size distribution of the product according to the invention.

Table 1

| | Ni | C | Si |
|---|---|---|---|
| Prior-art (% by weight) | 23.0 | 2.15 | 2.25 |
| Invention (% by weight) | 22.5 | 2.20 | 2.50 |

Table 2

| | Shape | Bulk specific gravity | Angle of repose | Melt casting temperature |
|---|---|---|---|---|
| Prior-art | Thin shapeless film | 0.70 | 42° | 1,350~1,400° C. |
| Invention | Ball or flat ball | 4.0 | 27° | 1,400~1,450° C. |

Table 3

| +20mm | 10~20mm | 5~10mm | −5mm |
|---|---|---|---|
| 20.0 weight % | 62.0 weight % | 16.0 weight % | 2.0 weight % |

As is apparent from Tables 2 and 3, with deoxidizing treatment effected by the method according to the invention granules of satisfactory shape and narrow size distribution could be obtained.

EXAMPLE 2

15 t of fused ferronickel (at 1,480° C. transferred to the ladle and having the composition as shown in Table 4) was deoxidized by adding 20 to 30 kg of lumped ferromanganese (containing 75% by weight of Mn) and holding the resultant mixture for several minutes. Then, granular ferronickel was produced in the same manner as described in Example 1, and the character and composition of shots which were obtained in each test were analyzed.

Table 4

| Test No. | Deoxidizing agent Fe-Mn | | Composition (in weight %) Ni | Co | Si | C | $O_2$ | Shot Shape | Bulk specific gravity | Angle of repose |
|---|---|---|---|---|---|---|---|---|---|---|
| 1 | 20kg | Before deoxidization | 25.11 | 0.59 | 2.00 | 1.46 | 0.0017 | | | |
| " | | After deoxidization | " | " | " | " | 0.0013 | | | |
| " | | Shot | 25.11 | 0.59 | 2.00 | 1.46 | — | Ball or flat ball | 3.8 | 29° |
| 2 | 25kg | Before deoxidization | 23.64 | 0.55 | 2.50 | 1.24 | 0.0024 | | | |
| " | | After deoxidization | " | " | " | " | 0.0022 | | | |
| " | | Shot | 23.64 | 0.55 | 2.50 | 1.24 | — | Ball or flat ball | 4.1 | 26° |

What we claim is:

1. A method of manufacturing granular ferronickel from fused ferronickel containing no less than 0.1% by weight of carbon by deoxidizing said fused ferronickel with addition of a deoxidizing agent and then water granulating the resultant mixture.

2. The method according to claim 1, wherein said fused ferronickel contains 0.2 to 3.0% by weight of carbon.

3. The method according to claim 1, wherein said deoxidizing agent is at lease one member selected from the group consisting of Al, ferrosilicon and ferromanganese.

4. The method according to claim 1, wherein an inert gas is blown into the melt at the time of said addition of the deoxidizing agent.

5. The method according to claim 1, wherein a vacuum degassing apparatus is used at the time of said addition of the deoxidizing agent.

6. The method according to claim 4, wherein a vacuum degassing apparatus is used in combination at the time of said addition of the deoxidizing agent.

7. The method according to claim 4, wherein said inert gas is argon gas.

8. The method according to claim 1, wherein the amount of said deoxidizing agent is about 1/1,000 by weight of said fused ferronickel.

* * * * *